US005333815A

United States Patent [19]

Sardanowsky

[11] Patent Number: 5,333,815

[45] Date of Patent: Aug. 2, 1994

[54] IMAGING SYSTEM FOR A MISSILE

[75] Inventor: Wladimir Sardanowsky, München, Fed. Rep. of Germany

[73] Assignee: Deutsche Aerospace AG, Munich, Fed. Rep. of Germany

[21] Appl. No.: 24,223

[22] Filed: Mar. 1, 1993

[30] Foreign Application Priority Data

Mar. 17, 1992 [DE] Fed. Rep. of Germany ..... 4208516

[51] Int. Cl.[5] ..... F41G 7/22; H04N 3/30

[52] U.S. Cl. ..... 244/3.16

[58] Field of Search ..... 244/3.16, 3.15, 3.17; 250/236, 203.2

[56] References Cited

U.S. PATENT DOCUMENTS 4,397,430 8/1983 Heidmann et al. ..... 244/3.16

4,717,822 1/1988 Byren ..... 244/3.16

FOREIGN PATENT DOCUMENTS

3007893A1 9/1981 Fed. Rep. of Germany .

3048496C1 7/1985 Fed. Rep. of Germany .

*Primary Examiner*—Daniel T. Pihulic

*Attorney, Agent, or Firm*—Evenson, McKeown, Edwards & Lenahan

[57] ABSTRACT

An imaging system for a missile rotating about a principal axis (A) has an imaging lens arrangement 6 and a detector arrangement 8 situated in the focal plane of the imaging lens arrangement for the generating of electric image signals which are processed while the respective rotating position of the missile is taken into account to achieve a high image definition in a manner that is very simple technically as well as with respect to signal processing techniques, the detector arrangement and the imaging lens arrangement with their optical axis are arranged to carry out the same motion as the missile while rotating about the principal axis of the missile, and the detector arrangement comprises one or several detector row(s) which extend from the image field edge of the imaging lens arrangement toward the missile axis.

22 Claims, 2 Drawing Sheets

IMAGING SYSTEM FOR A MISSILE

BACKGROUND AND SUMMARY OF THE INVENTION

This invention relates to an imaging system for a missile which rotates about a principal axis, comprising an imaging lens arrangement and a detector arrangement situated in the focal plane of the imaging lens arrangement for the generating of electric image signals which are processed while the respective rotating position of the missile is taken into account.

Infrared imaging systems for missiles are known which comprise an imaging lens arrangement which is fixed to the missile and an electro-optic detector mosaic which is also fixedly connected with the missile and which is composed of detector elements which are distributed flatly in the focal plane of the imaging lens arrangement and are scanned line-by-line. For a satisfactory image definition, imaging systems of this type require a very large number of detector elements and are therefore correspondingly expensive.

Infrared imaging devices are also known (German Patent Documents DE 30 07 893 A1; DE 30 48 496 C1) in which field of view of the imaging lens arrangement swivels mechanically by means of an oscillating deflecting mirror or a gyroscopic drive, for example, over the viewed scene that is of interest and as a result, a linear or circular image scanning is achieved by means of a single row of detectors which extends over the field of view of the imaging lens arrangement. The mechanical complexity for an exact control of the image movement and the computing volume needed for the correlating of the individual image signals to the corresponding image points are considerable.

It is an object of the invention to develop the imaging system of the initially mentioned type in such a manner that a perfect image quality with a high image resolution can be achieved in a manner that is simple with respect to the construction and signal technology and has comparatively few detector elements.

According to the invention, this object is achieved by means of an imaging system of the above-mentioned type, wherein the detector arrangement 8 and the imaging lens arrangement 6 with their optical axis are arranged carrying out the same motion as the missile 2 to be rotating about a principal axis (A) of the missile, and the detector arrangement comprises one or several detector row 14 extending toward the axis of the missile.

According to preferred embodiments of the invention, a complicated mechanical image control is not needed. By means of a targeted utilization of the self-rotation of the missile in conjunction with the detector arrangement, which is radial with respect to the missile axis and comprises relatively few individual elements, a continuous image rotation is achieved in a constructively very simple manner and with an image scanning which is polar with respect to the missile axis. Thus, from the image signals according to the respective rotating position of the missile as well as the radial distance of the individual detector elements from the axis of rotation of the missile, a non-rotating image of the viewing scene that is of interest is obtained with low computing expenditures and a high image resolution. Because of its simple construction and its high image quality, the imaging device according to the invention is excellently suited for rotating missiles, but naturally also for other moved carrier systems which carry out a continuous rotation about a principal axis.

In further advantageous aspects of preferred embodiments of the invention, instead of a single detector row, preferably several detector rows are provided which are each arranged to be angularly offset to one another with respect to the missile axis, whereby, in a very simple manner, specifically by the corresponding selection of the frequency sensitivity of the individual detector rows, a frequency-selective image scanning and/or an image scanning frequency increase can be achieved with respect to the rotational frequency of the missile.

In order to be able to change the field of view of the imaging lens arrangement, this imaging lens arrangement is preferably adjustable in a swivelling manner with respect to the missile axis, while the detector rows, for reasons of constructional simplification, are expediently rigidly connected with the missile. In the case of a swivelling fastening of the imaging lens arrangement, the detector rows are in each case constructed preferably configured to have a circular-arc shape with the center of the curvature being in the swivel center of the imaging lens arrangement.

In certain preferred embodiments a detector arrangement according to the invention for the infrared image scanning is provided, which consists of one or at most a few detector rows fixed to the missile, it was found, as another advantage of the invention, that high-expenditure cooling measures, as they are otherwise required for infrared image devices with large-area or rotating detector arrangements, are not necessary.

In order to be able to image with a high image definition the overall scene as well as scene cutouts that are of interest, it is finally recommended according to preferred embodiments to use an imaging lens arrangement with a continuously variable focal length.

Other objects, advantages and novel features of the present invention will become apparent from the following detailed description of the invention when considered in conjunction with the accompanying drawings.

DETAILED DESCRIPTION OF THE DRAWINGS

Figure 1:
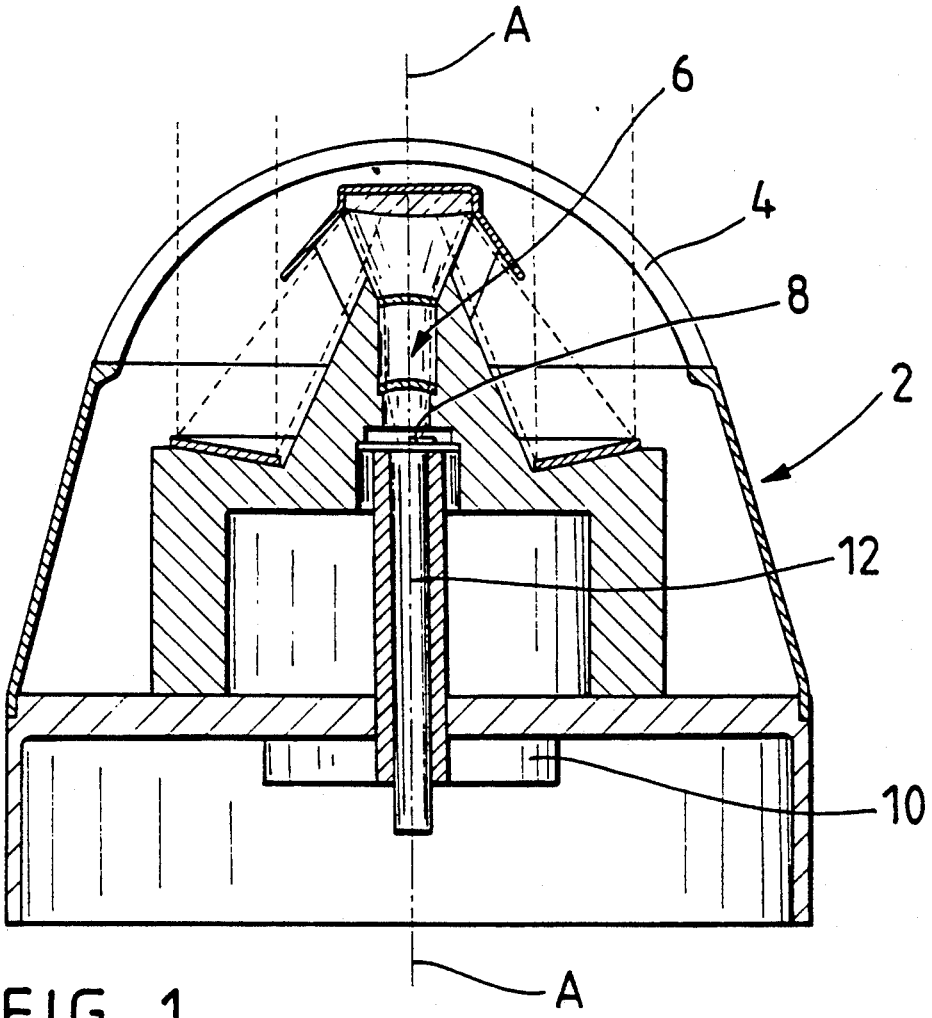
FIG. 1 is a very schematic longitudinal sectional view of an imaging system arranged on the nose end of a missile, constructed according to a preferred embodiment of the invention.

The imaging system according to FIG. 1 which is arranged on the forward end of a missile 2 which rotates about its longitudinal axis A—A. The imaging system is arranged within the protection of an infrared dome 4 and comprises as the main components: (i) an infrared imaging lens arrangement 6 which, with its optical axis, is coaxial with respect to the missile axis, consists of individual elements fixed to the missile, and has a variable focal length in the manner of a multi-lens zoom lens device and (ii) an infrared detector arrangement 8 which is arranged in the focal plane of the imaging lens arrangement 6, also fixed to the missile, and is connected to an electronic system 10 for the processing of the electric image signals generated by the detector arrangement 8 and has a central cryostatic cooling device 12.

Figure 2:
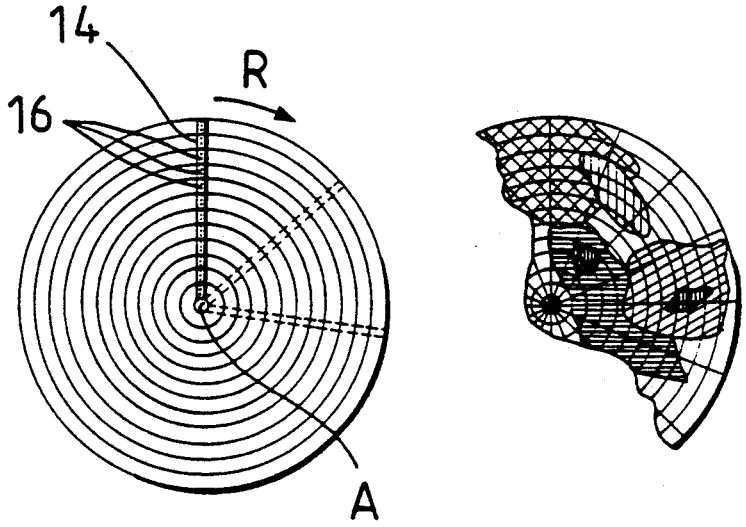
FIG. 2 is a very schematic representation of a single detector row of the imaging system according to FIG. 1 with polar image scanning as well as of a cutout of a resulting image.

According to FIG. 2, the detector arrangement 8 comprises a single linear row 14 of individual detector elements 16 which extends from the missile axis A radially toward the outside to the image field edge of the imaging lens arrangement 6, and thus corresponds in its length and number of elements approximately to a half line of a detector mosaic of the same image definition which flatly covers the image field. Since the detector row 14 rotates about the missile axis A with the same motion as the missile 2 (rotating direction R), a rotational image movement of the stationary scene image is created relative to the detector row 14 with a polar image scanning in such a manner that the scene image is scanned by the individual detector elements 16 on mutually concentric circles. From the image signals generated by the detector elements 16, the assigned image points can be determined on the basis of a polar coordinate representation in a manner that is very simple with respect to signal processing techniques, according to the radial distance of the respective detector element 16 from the missile axis A and the rotating position of the missile 2 and thus of the detector row 14 in the reading point in time. In this manner, a reproduction of the image of the viewing scene that is of interest is achieved which is unaffected by the missile rotation—illustrated as a cutout in FIG. 2—, perhaps in a visual form on a video screen or by means of data transmission to an automatic image monitoring or data processing device.

Figure 3:
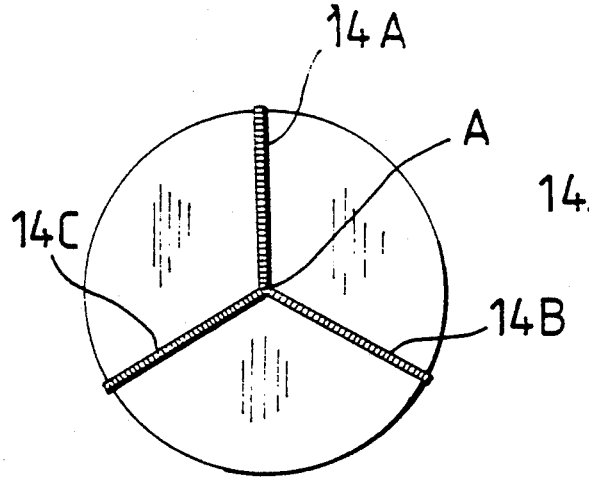
FIG. 3 is a view of an arrangement of several detector rows, which are sensitive in the same frequency range, for the purpose of increasing the image scanning frequency, constructed according to a preferred embodiment of the invention.

While, in the case of the arrangement of a single detector row 14, the image field of the imaging lens arrangement 6 is scanned once during each rotation of the missile 2, it is also easily possible to multiply the image scanning rate with respect to the rotating frequency; perhaps triple it according to FIG. 3 by the fact that, instead of a single detector row, three detector rows 14 A, B and C are provided which extend radially with respect to the missile axis A at a uniform angular distance.

Figure 4:
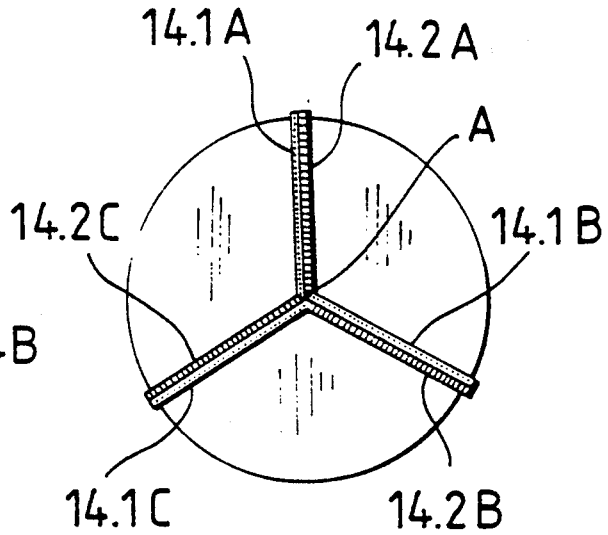
FIG. 4 is a view similar to FIG. 3 of a detector arrangement which comprises several detector rows for the purpose of increasing the image scanning frequency as well as for the image scanning in different frequency ranges, constructed according to another preferred embodiment of the invention.

Selectively or according to FIG. 4, the image scanning may, in addition, also take place in different frequency ranges, in which case, for each frequency range, one detector row 14 or—in the case of an image scanning rate that is increased with respect to the rotating frequency according to FIG. 4—several detector rows, specifically 14.1 A . . . C are provided for a first frequency range and the detector rows 14.2 A . . . C are provided for a second frequency range.

Figure 5:
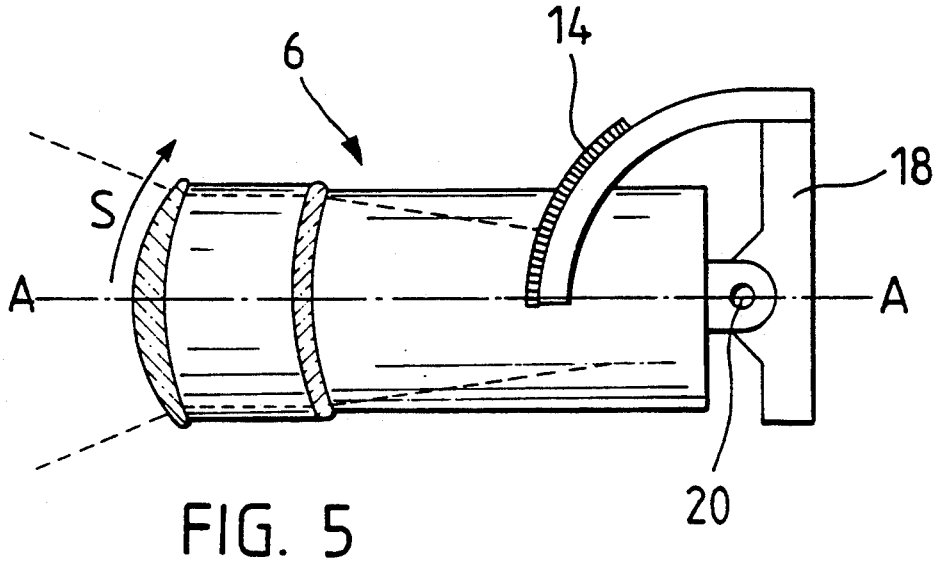
FIG. 5 is a view of a modification of the imaging system according to FIG. 1 with an imaging lens arrangement which can be adjusted in a swivelling manner.

According to the modification illustrated in FIG. 5, the imaging lens arrangement 6 is arranged on a carrier 18 fixed to the missile so that it can be adjusted in an angularly movable manner about a swivel axis 20 situated on the missile axis A, while the detector row or rows continue to be rigidly connected with the missile but is or are constructed concentrically to the swivel axis 20 in the shape of a circular arc and is or are lengthened in the swivel direction S of the imaging lens arrangement 6 to such an extent that, in each adjusting position of the imaging lens arrangement 6, it or they reach to the outer edge of the image field. By means of a swivel position adjustment of the imaging lens arrangement 6, the scanned viewing scene may be changed or a sighted target area can be held in the field of view of the imaging lens arrangement 6, even if the flight direction and/or the spatial alignment of the missile axis A changes during the flight.

The imaging system according to the invention is not necessarily limited to rotating missiles, but may also be used for other carrier systems, such as torpedoes, which rotate continuously about a principal axis.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. An imaging system for a missile rotating about a missile principal axis comprising:

an imaging lens arrangement, a detector arrangement situated in the focal plane of the imaging lens arrangement for generating electric image signals, said detector arrangement comprising at least one detector row extending transversely with respect to the missile principal axis, said detector arrangement and imaging lens arrangement being arranged to carry out the same rotating motion as the missile about the missile principal axis, and a polar signal image processing system which utilizes the distance of individual detector elements from the missile principal axis as a radius vector and the respective angle of rotation of the missile as a polar angle for generating a non-rotating two-dimensional image from the electric image signals of the detector arrangement.

2. An imaging system for a missile rotating about a principal axis, comprising an imaging lens arrangement and a detector arrangement situated in the focal plane of the imaging lens arrangement for the generating of electric image signals which are processed while the respective rotating position of the missile is taken into account, wherein the detector arrangement and the imaging lens arrangement with their optical axis are arranged for carrying out the same motion as the missile rotating about a principal axis of the missile, wherein the detector arrangement comprises at least one detector row extending toward the axis of the missile, and wherein several detector rows are provided for frequency-selective image scanning, and wherein each detector row responds to different frequency ranges and is arranged mutually offset at an angle with respect to the missile axis.

3. An imaging system according to claim 1, wherein several detector rows are provided for achieving an image scanning rate which is increased with respect to the rotating frequency, and wherein said detector rows are configured to respond to the same frequency range and are arranged mutually offset at an angle with respect to the missile axis.

4. An imaging system according to claim 1, wherein the imaging lens arrangement is mounted to be swivellably adjusted with respect to the missile axis.

5. An imaging system according to claim 2, wherein the imaging lens arrangement is mounted to be swivellably adjusted with respect to the missile axis.

6. An imaging system according to claim 3, wherein the imaging lens arrangement is mounted to be swivellably adjusted with respect to the missile axis.

7. An imaging system according to claim 1, wherein each of the at least one detector row is rigidly fastened to the missile.

8. An imaging system according to claim 2, wherein each of the at least one detector row is rigidly fastened to the missile.

9. An imaging system according to claim 3, wherein each of the at least one detector row is rigidly fastened to the missile.

10. An imaging system according to claim 5, wherein the detector rows are each constructed in the shape of a circular arc with the curvature center in the swivel center of the imaging lens arrangement.

11. An imaging system according to claim 6, wherein the detector rows are each constructed in the shape of a circular arc with the curvature center in the swivel center of the imaging lens arrangement.

12. An imaging system according to claim 1, wherein infrared detectors are provided as the detectors in each of the at least one detector rows.

13. An imaging system according to claim 2, wherein infrared detectors are provided as the detectors in each of the at least one detector rows.

14. An imaging system according to claim 3, wherein infrared detectors are provided as the detectors in each of the at least one detector rows.

15. An imaging system for a missile rotating about a principal axis, comprising an imaging lens arrangement and a detector arrangement situated in the focal plane of the imaging lens arrangement for the generating of electric image signals which are processed while the respective rotating position of the missile is taken into account, wherein the detector arrangement and the imaging lens arrangement with their optical axis are arranged for carrying out the same motion as the missile rotating about a principal axis of the missile, wherein the detector arrangement comprises at least one detector row extending toward the axis of the missile, and wherein the imaging lens arrangement has a continuously variable focal length.

16. An imaging system according to claim 2, wherein the imaging lens arrangement has a continuously variable focal length.

17. An imaging system according to claim 1, wherein the imaging lens arrangement has a continuously variable focal length.

18. An imaging system according to claim 1, wherein the two-dimensional image is a video image.

19. An imaging system according to claim 1, wherein several detector rows are provided for frequency-selective image scanning, and wherein each detector row responds to different frequency ranges and is arranged mutually offset at an angle with respect to the missile axis.

20. An imaging system according to claim 1, wherein the imaging lens arrangement has a continuously variable focal length.

21. An imaging system according to claim 19, wherein the two-dimensional image is a video image.

22. An image system according to claim 20, wherein the two-dimensional image is a video image.

* * * * *